US006488216B1

(12) United States Patent
Lewis

(10) Patent No.: US 6,488,216 B1
(45) Date of Patent: Dec. 3, 2002

(54) CLEANING ATTACHMENT FOR A SPRAY GUN

(76) Inventor: Derek R. Lewis, 45 Palmer Mill Rd., Halifax, MA (US) 02338

( * ) Notice: Subject to any disclaimer, the term of this patent is extended or adjusted under 35 U.S.C. 154(b) by 63 days.

(21) Appl. No.: 09/709,270

(22) Filed: Nov. 10, 2000

(51) Int. Cl.[7] ..... B05B 15/02

(52) U.S. Cl. ..... 239/106; 239/112; 239/119; 239/125; 239/289; 134/102.1

(58) Field of Search ..... 239/106, 107, 239/110–113, 116, 118, 119, 122, 125, 124, 289, 302–379, DIG. 14

(56) References Cited

U.S. PATENT DOCUMENTS

| | | | | | |
|---|---|---|---|---|---|
| 1,816,555 | A | | 7/1931 | Ward | |
| 2,569,125 | A | * | 9/1951 | Costantino | 134/182 |
| 2,726,667 | A | | 12/1955 | Wigmore | |
| 2,745,418 | A | | 5/1956 | Balcom et al. | |
| 4,522,789 | A | * | 6/1985 | Kelly et al. | 239/113 |
| D285,477 | S | | 9/1986 | Hengesbach | |
| 4,746,063 | A | | 5/1988 | Roberts | |
| 4,934,393 | A | * | 6/1990 | Lighthall et al. | 239/106 |
| 5,069,389 | A | * | 12/1991 | Bitsakos | 239/289 |
| 5,582,350 | A | | 12/1996 | Kosmyna et al. | |
| 5,855,218 | A | * | 1/1999 | Giannetti | 134/102.1 |
| 6,179,222 | B1 | * | 1/2001 | Stecher | 239/112 |

* cited by examiner

*Primary Examiner*—Michael Mar
*Assistant Examiner*—Dinh Q. Nguyen

(57) ABSTRACT

A cleaning attachment for a spray gun for effectively and efficiently cleaning a paint spray gun after use. The cleaning attachment for a spray gun includes a hose having a first end and a second end; and also includes a lid assembly including a lid having a wall for securely closing a top of a paint container mounted to a spray gun with the lid assembly further having a hose fitting disposed through the wall of said lid and being connected to the hose and with the lid assembly also having a ventilation assembly being securely disposed through the wall of said lid; and further includes hose connectors being securely attached to the first and second ends of the hose.

14 Claims, 2 Drawing Sheets

CLEANING ATTACHMENT FOR A SPRAY GUN

BACKGROUND OF THE INVENTION

1. Field of the Invention

The present invention relates to a spray gun cleaner attachment and more particularly pertains to a new cleaning attachment for a spray gun for effectively and efficiently cleaning a paint spray gun after use.

2. Description of the Prior Art

The use of a spray gun cleaner attachment is known in the prior art. More specifically, a spray gun cleaner attachment heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,746,063; 1,816,555; 2,745,418; 2,726,667; 5,582,350; and Des. 285,477.

While these devices fulfill their respective, particular objectives and requirements, the aforementioned patents do not disclose a new cleaning attachment for a spray gun. The inventive device includes a hose having a first end and a second end; and also includes a lid assembly including a lid having a wall for securely closing a top of a paint container mounted to a spray gun with the lid assembly further having a hose fitting disposed through the wall of said lid and being connected to the hose and with the lid assembly also having a ventilation assembly being securely disposed through the wall of said lid; and further includes hose connectors being securely attached to the first and second ends of the hose.

In these respects, the cleaning attachment for a spray gun according to the present invention substantially departs from the conventional concepts and designs of the prior art, and in so doing provides an apparatus primarily developed for the purpose of effectively and efficiently cleaning a paint spray gun after use.

SUMMARY OF THE INVENTION

In view of the foregoing disadvantages inherent in the known types of spray gun cleaner attachment now present in the prior art, the present invention provides a new cleaning attachment for a spray gun construction wherein the same can be utilized for effectively and efficiently cleaning a paint spray gun after use.

The general purpose of the present invention, which will be described subsequently in greater detail, is to provide a new cleaning attachment for a spray gun which has many of the advantages of the spray gun cleaner attachment mentioned heretofore and many novel features that result in a new cleaning attachment for a spray gun which is not anticipated, rendered obvious, suggested, or even implied by any of the prior art spray gun cleaner attachment, either alone or in any combination thereof.

To attain this, the present invention generally comprises a hose having a first end and a second end; and also includes a lid assembly including a lid having a wall for securely closing a top of a paint container mounted to a spray gun with the lid assembly further having a hose fitting disposed through the wall of said lid and being connected to the hose and with the lid assembly also having a ventilation assembly being securely disposed through the wall of said lid; and further includes hose connectors being securely attached to the first and second ends of the hose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning attachment for a spray gun which has many of the advantages of the spray gun cleaner attachment mentioned heretofore and many novel features that result in a new cleaning attachment for a spray gun which is not anticipated, rendered obvious, suggested, or even implied by any of the prior art spray gun cleaner attachment, either alone or in any combination thereof.

It is another object of the present invention to provide a new cleaning attachment for a spray gun which may be easily and efficiently manufactured and marketed.

It is a further object of the present invention to provide a new cleaning attachment for a spray gun which is of a durable and reliable construction.

An even further object of the present invention is to provide a new cleaning attachment for a spray gun which is susceptible of a low cost of manufacture with regard to both materials and labor, and which accordingly is then susceptible of low prices of sale to the consuming public, thereby making such cleaning attachment for a spray gun economically available to the buying public.

Still yet another object of the present invention is to provide new cleaning attachment for a spray gun which provides in the apparatuses and methods of the prior art some of the advantages thereof, while simultaneously overcoming some of the disadvantages normally associated therewith.

Still another object of the present invention is to provide a new cleaning attachment for a spray gun for effectively and efficiently cleaning a paint spray gun after use.

Yet another object of the present invention is to provide a new cleaning attachment for a spray gun which includes a hose having a first end and a second end; and also includes a lid assembly including a lid having a wall for securely closing a top of a paint container mounted to a spray gun with the lid assembly further having a hose fitting disposed through the wall of said lid and being connected to the hose and with the lid assembly also having a ventilation assembly being securely disposed through the wall of said lid; and further includes hose connectors being securely attached to the first and second ends of the hose.

Still yet another object of the present invention is to provide a new cleaning attachment for a spray gun that utilizes very little cleaning fluid and prevents large messes from cleaning the spray gun.

Even still another object of the present invention is to provide a new cleaning attachment for a spray gun that saves the painter time and effort over time-consuming and labor-intensive methods of cleaning the spray gun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
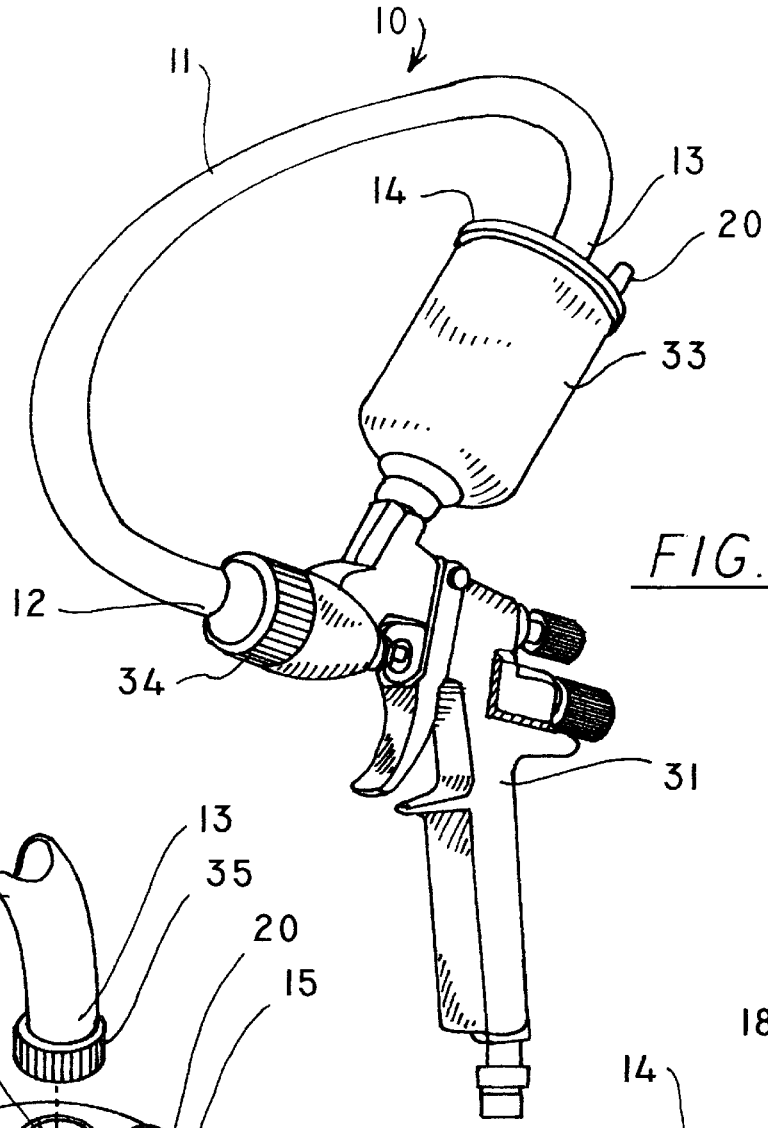
FIG. 1 is a perspective view of a new cleaning attachment for a spray gun according to the present invention and shown in use.
Figure 2:
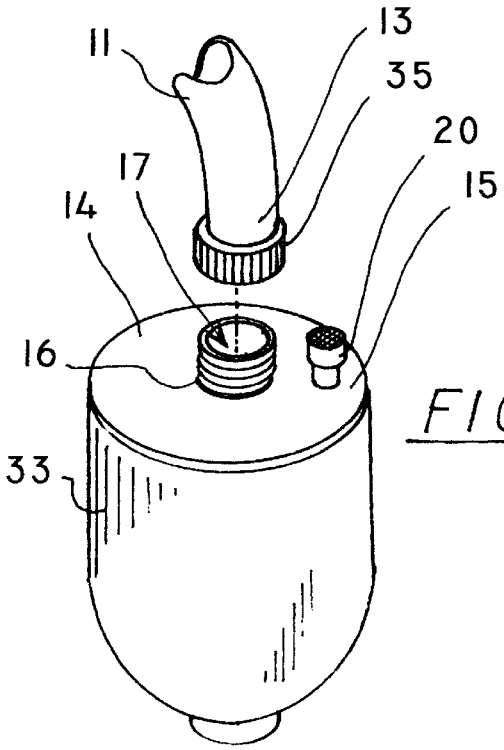
FIG. 2 is a detailed partial perspective view of the hose and the lid for the paint container of present invention.
Figure 3:
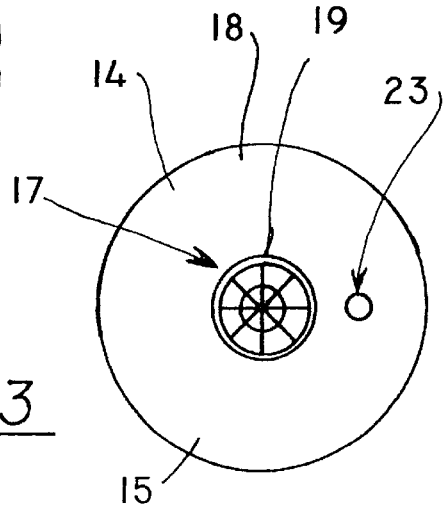
FIG. 3 is a bottom plan view of the lid of the present invention.
Figure 4:
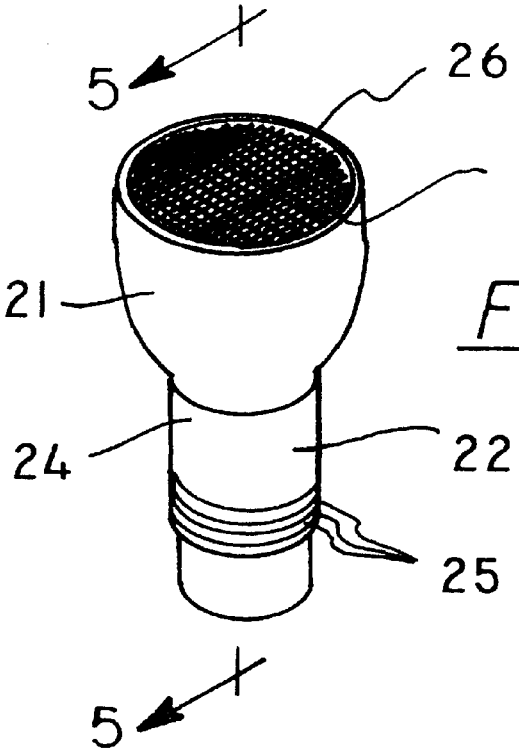
FIG. 4 is a perspective view of the ventilation assembly of the present invention.
Figure 5:
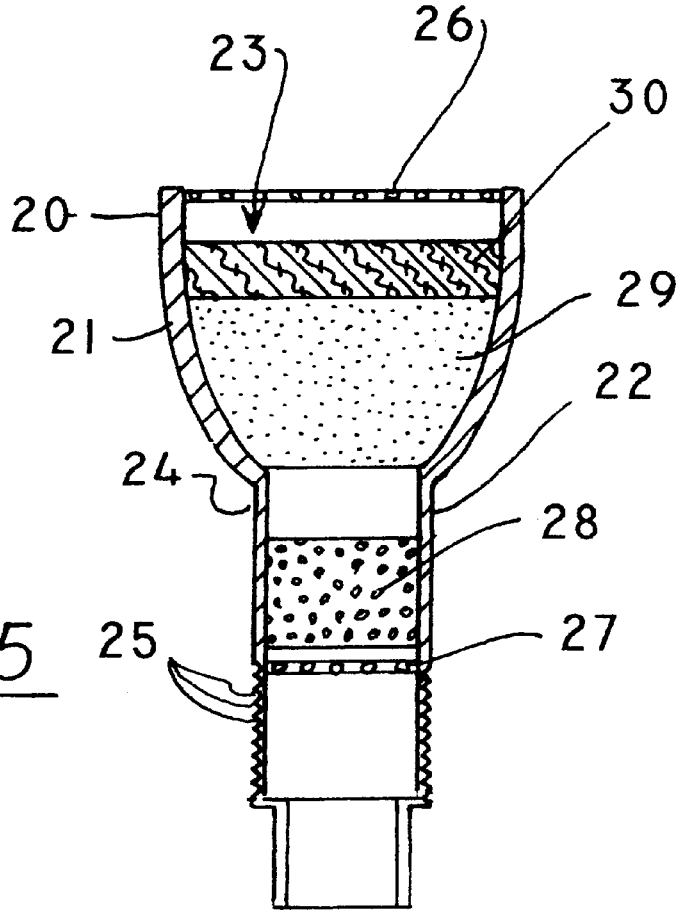
FIG. 5 is a cross-sectional view of the ventilation assembly of the present invention.

With reference now to the drawings, and in particular to FIGS. 1 through 5 thereof, a new cleaning attachment for a spray gun embodying the principles and concepts of the present invention and generally designated by the reference numeral 10 will be described.

As best illustrated in FIGS. 1 through 5, the cleaning attachment for a spray gun 10 generally comprises a hose 11 having a first end 12, and a second end 13 and having a length of approximately 12 to 15 inches. A lid assembly includes a lid 14 having a wall 15 for securely closing a top of a paint container 33 conventionally mounted to a spray gun 31. The lid assembly further has a hose fitting 16 being conventionally disposed through the wall 15 of the lid 14 and being connected to the hose 11. The lid assembly also has a ventilation assembly being securely and conventionally disposed through the wall 15 of the lid 14. The hose fitting 16 has a bore 17 extending therethrough and through the wall 15 of the lid 14. The fitting 16 is generally a boss having effectively seal the top of the paint container 33. The ventilation assembly includes a pressure release member 20 having a wall 24 and a bore 23 extending therethrough. The pressure release member 20 is securely threaded through the wall 15 of the lid 14 and has a lower stem portion 22 and an upper portion 21. The wall 24 has a threaded exterior 25 extending along and about the lower stem portion 22. The ventilation assembly also includes an upper screen member 26 which is securely and conventionally mounted in the bore 23 at a top end of the upper portion 21, and further includes a lower screen member 27 which is securely and conventionally mounted in the bore 23 in the lower stem portion 22. The ventilation assembly further includes a sponge 28 being securely and conventionally disposed in the bore 23 above the lower screen member 27, and also includes activated charcoal 29 being conventionally disposed in the bore 23 in the upper portion 21, and further includes cloth material 30 being conventionally disposed in the bore 23 between the upper screen member 26 and the activated charcoal 29. The lid assembly further includes a spray nozzle 19 being securely and conventionally attached to an underside 18 of the lid 14 and being adapted to spray cleaning fluid upon walls of the paint container 33.

Hose connectors 34,35 are securely and conventionally attached to the first and second ends 12,13 of the hose 11. The first end 12 of the hose 11 is adapted to be removably attached to a nozzle of the spray gun 31 with one of the hose connectors 34, and the second end 13 of the hose 11 is adapted to be removably attached to the hose fitting 16 with the other of the hose connectors 35.

In use, the user fills the paint container 33 with cleaning fluid after using the spray gun 31, and pulls the trigger of the spray gun 31 which urges cleaning fluid from the paint container 33 through the hose 11 and back into the paint container 33 with the spray nozzle 19 being adapted to spray the inside walls of the paint container 33 to essentially clean and remove the paint from the inside walls of the paint container 33. The user can repeatedly urge the cleaning fluid through the paint container without having to add more cleaning fluid by simply recycling the cleaning fluid through the hose 11. The pressure release member 20 effectively dissipates the buildup of pressure inside the paint container 33 with the activated charcoal 29, the sponge 28 and the cloth material 30 effectively removing odors and capturing any cleaning fluid and paint residue that may otherwise escape through the bore 23 of the pressure release member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning attachment for a spray gun comprising:

a hose having a first end and a second end;

a lid assembly having a lid with a wall for securely closing a top of a paint container mounted to a spray gun, said lid assembly further having a hose fitting disposed through said wall of said lid and being connected to said hose, said lid assembly also having a ventilation assembly being securely disposed through said wall of said lid;

hose connectors being securely attached to said first and second ends of said hose;

wherein said ventilation assembly includes a pressure release member having a wall and a bore extending therethrough, said pressure release member being securely threaded through said wall of said lid and having a lower stem portion and an upper portion; and wherein said wall of said pressure release member has a threaded exterior extending along and about said lower stem portion such that said lower stem portion is threadably couplable to said wall of said lid.

2. A cleaning attachment for a spray gun as described in claim 1, wherein said hose fitting has a bore extending therethrough and through said wall of said lid, said fitting being generally a boss having a threaded exterior.

3. A cleaning attachment for a spray gun as described in claim 1, wherein said first end of said hose is adapted to be removably attached to a nozzle of the spray gun with one of said hose connectors, and said second end of said hose is adapted to be removably attached to said hose fitting with the other of said hose connectors.

4. A cleaning attachment for a spray gun as described in claim 1, wherein said wall of said lid is adapted to effectively seal the top of the paint container.

5. A cleaning attachment for a spray gun as described in claim 1, wherein said wall of said pressure release member has a threaded exterior extending along and about said lower stem portion.

6. A cleaning attachment for a spray gun as described in claim 1, wherein said ventilation assembly also includes an upper screen member which is securely mounted in said bore of said pressure release member at a top end of said upper portion, and further includes a lower screen member which is securely mounted in said bore of said pressure release member in said lower stem portion.

7. A cleaning attachment for a spray gun as described in claim 6, wherein ventilation assembly further includes a sponge being securely disposed in said bore of said pressure release member above said lower screen member, and also includes activated charcoal being disposed in said bore of said pressure release member in said upper portion, and further includes cloth material being disposed in said bore of said pressure release member between said upper screen member and said activated charcoal.

8. A cleaning attachment for a spray gun as described in claim 1, wherein said lid assembly further includes a spray nozzle being securely attached to an underside of said lid and being adapted to spray cleaning fluid upon walls of the paint container.

9. A cleaning attachment for a spray gun comprising:

a hose having a first end and a second end;

a lid assembly having a lid with a wall for securely closing a top of a paint container mounted to a spray gun, said lid assembly further having a hose fitting disposed through said wall of said lid and being connected to said hose, said lid assembly also having a ventilation assembly being securely disposed through said wall of said lid;

hose connectors being securely attached to said first and second ends of said hose, wherein said hose fitting has a bore extending therethrough and through said wall of said lid, said fitting being generally a boss having a threaded exterior;

wherein said first end of said hose is adapted to be removably attached to a nozzle of the spray gun with one of said hose connectors, and said second end of said hose is adapted to be removably attached to said hose fitting with the other of said hose connectors;

wherein said wall of said lid is adapted to effectively seal the top of the paint container; and wherein said ventilation assembly includes a pressure release member having a wall and a bore extending therethrough, said pressure release member being securely threaded through said wall of said lid and having a lower stem portion and an upper portion.

10. A cleaning attachment for a spray gun as described in claim 9, wherein said wall has a threaded exterior extending along and about said lower stem portion.

11. A cleaning attachment for a spray gun as described in claim 9, wherein said ventilation assembly also includes an upper screen member which is securely mounted in said bore at a top end of said upper portion, and further includes a lower screen member which is securely mounted in said bore in said lower stem portion.

12. A cleaning attachment for a spray gun as described in claim 11, wherein ventilation assembly further includes a sponge being securely disposed in said bore above said lower screen member, and also includes activated charcoal being disposed in said bore in said upper portion, and further includes cloth material being disposed in said bore between said upper screen member and said activated charcoal.

13. A cleaning attachment for a spray gun as described in claim 9, wherein said lid assembly further includes a spray nozzle being securely attached to an underside of said lid and being adapted to spray cleaning fluid upon walls of the paint container.

14. A cleaning attachment for a spray gun comprising:

a hose having a first end and a second end and having a length of approximately 12 to 15 inches;

a lid assembly having a lid with a wall for securely closing a top of a paint container mounted to a spray gun, said lid assembly further having a hose fitting disposed through said wall of said lid and being connected to said hose, said lid assembly also having a ventilation assembly being securely disposed through said wall of said lid, said hose fitting having a bore extending therethrough and through said wall of said lid, said fitting being generally a boss having a threaded exterior, said wall of said lid being adapted to effectively seal the top of the paint container, said ventilation assembly including a pressure release member having a wall and a bore extending therethrough, said pressure release member being securely threaded through said wall of said lid and having a lower stem portion and an upper portion, said wall having a threaded exterior extending along and about said lower stem portion, said ventilation assembly also including an upper screen member which is securely mounted in said bore at a top end of said upper portion, and further including a lower screen member which is securely mounted in said bore in said lower stem portion, said ventilation assembly further including a sponge being securely disposed in said bore above said lower screen member, and also including activated charcoal being disposed in said bore in said upper portion, and further including cloth material being disposed in said bore between said upper screen member and said activated charcoal, said lid assembly further including a spray nozzle being securely attached to an underside of said lid and being adapted to spray cleaning fluid upon walls of the paint container; and hose connectors being securely attached to said first and second ends of said hose, said first end of said hose being adapted to be removably attached to a nozzle of the spray gun with one of said hose connectors, and said second end of said hose being adapted to be removably attached to said hose fitting with the other of said hose connectors.

* * * * *